US005795192A

United States Patent [19]

Ullrich

[11] Patent Number: 5,795,192

[45] Date of Patent: Aug. 18, 1998

[54] SOCKET FOR RECEIVING A RADIATION SOURCE AND A RADIATION SOURCE WITH A BASE

[75] Inventor: Bernd Ullrich, Erlensee, Germany

[73] Assignee: Heraeus Noblelight GmbH, Hanau, Germany

[21] Appl. No.: 692,328

[22] Filed: Aug. 5, 1996

[30] Foreign Application Priority Data

Aug. 31, 1995 [DE] Germany ..... 195 31 713.0

[51] Int. Cl.[6] ..... H01R 17/00

[52] U.S. Cl. ..... 439/619; 439/699.2

[58] Field of Search ..... 439/356, 619, 439/699.2, 375, 379

[56] References Cited

U.S. PATENT DOCUMENTS

| | | | |
|---|---|---|---|
| 4,713,019 | 12/1987 | Gaynor . | |
| 5,035,643 | 7/1991 | Forish et al. | 439/699.2 X |
| 5,207,600 | 5/1993 | Van Dulmen | 439/356 X |
| 5,456,620 | 10/1995 | Kaminski | 439/619 X |

FOREIGN PATENT DOCUMENTS

| | | |
|---|---|---|
| 82 31 975.8 | 4/1983 | Germany . |
| 85 20 290.8 | 10/1985 | Germany . |
| 93 14 625 | 1/1994 | Germany . |
| 345 492 | 3/1931 | United Kingdom . |

OTHER PUBLICATIONS

Masaaki Ichikawa, "Socket for Single Base Lamp", Abstract of JP 5-144528 A (Matsushita Electric Works, Ltd.), vol. 17, No. 525, Sep. 21, 1998, *Patent Abstracts of Japan*.

*Primary Examiner*—Khiem Nguyen

*Attorney, Agent, or Firm*—Frishauf, Holtz, Goodman, Langer & Chick, P.C.

[57] ABSTRACT

A socket for receiving a radiation source, such as a luminous source, having a base, the base having at least one groove-shaped depression thereon, the socket having a bottom portion defining a receptacle for receiving the base; a pair of walls extending upwardly from the bottom portion and being spaced apart from each other so as to receive the base therebetween; at least one of the walls having at least one protuberance which projects inwardly of the socket toward the other of the walls; the at least one protuberance being receivable in a corresponding groove-shaped depression in the base so as to guide and retain the base in the socket; the socket and the base being shiftable relative to each other along an axis, wherein the at least one protuberance and the groove-shaped depression extend in a direction substantially parallel to the axis.

20 Claims, 4 Drawing Sheets

SOCKET FOR RECEIVING A RADIATION SOURCE AND A RADIATION SOURCE WITH A BASE

BACKGROUND OF THE INVENTION

1. Field of the Invention

The present invention pertains to a socket (i.e., an electrical socket) for receiving a radiation source, such as a luminous source, such as a bulb or a discharge lamp (hereinafter simply referred to as a "bulb" or a "lamp") with a base. The socket and the base, as partners, form counterparts which are shiftable relative to each other along a given axis, in which projections on one partner correspond to (and fit into) recesses on the other partner. The present invention is also directed to a radiation source, such as a luminous source, having a base for insertion into a socket.

2. Background Information

U.S. Pat. No. 4,713,019 (the entire contents of which are hereby incorporated by reference) discloses a socket for receiving fluorescent lamps, in which the socket includes a central encoding slot (key slot) to receive an encoding projection (key protrusion) in the base of the fluorescent lamps, which are inserted in the socket. In addition, U.S. Pat. No. 4,713,019 provides for the possibility to combine various pin orientations with corresponding projection positions in order to ensure that different lamp types and power rating (wattage) categories are not confused with each other. U.S. Pat. No. 4,713,019 presents a difficulty that despite the recesses or depressions provided in the socket, lamp types without corresponding counterparts or, for example, mismatched lamp types with broken-off pins, nonetheless can be inserted in the socket.

German utility-model patent G 85 20 290 discloses a luminous source including a glass bulb, which features a socket which is cemented on at both ends, wherein the socket is a cylindrical component with an extension. With this construction it is possible to carry out an exact positioning of luminous sources equipped with sockets on two sides into their holder.

SUMMARY OF THE INVENTION

An object of the present invention is to provide sockets which allow for the insertion of only certain types of radiation sources such as bulbs or lamps to permit proper operation, without any interference or damage by mismatched bulbs or lamps, which may occur when changing bulbs or lamps.

Another object of the present invention is to provide for an exact orientation of bulbs or lamps in a matching socket.

A further object of the present invention is to provide for the appropriate placement of bulbs or lamps in a socket.

A still further object of the present invention is to allow for single-side base bulbs or lamps to be disposed in sockets suitable for them with specified power ratings and without running the risk of mismatching or mix-ups.

An additional object of the present invention is to provide for an optimum orientation of a bulb or lamp with respect to an optical system such as, for example, a reflector arrangement.

The above objects and other advantages are satisfied by the present invention.

The present invention relates to a socket for receiving a radiation source, such as a luminous source, having a base, the base having at least one groove-shaped depression thereon, the socket comprising:

a bottom portion defining a receptacle for receiving the base, a pair of walls extending upwardly from the bottom portion and being spaced apart from each other so as to receive the base therebetween, at least one of the walls having at least one protuberance which projects inwardly of the socket toward the other of the walls, the at least one protuberance being receivable in a corresponding groove-shaped depression in the base so as to guide and retain the base in the socket, the socket and the base being shiftable relative to each other along an axis, and wherein the at least one protuberance and the groove-shaped depression extend in a direction substantially parallel to the axis.

The present invention also concerns a radiation source, such as a luminous source comprising:

a radiation emitting member, such as a light emitting member, a base for supporting the radiation emitting member, the base having at least one groove-shaped depression for engagement with a socket, the socket having at least one protuberance being receivable in the at least one groove-shaped depression in the base, the socket and the base being shiftable relative to each other along an axis, wherein the at least one protuberance and the groove-shaped depression extend in a direction substantially parallel to the axis.

BRIEF DESCRIPTION OF THE DRAWINGS

For the purposes of illustrating the present invention there is shown in the drawings forms which are presently preferred. It is to be understood, however, that the present invention is not limited to the precise arrangements and instrumentalities depicted in the drawings.

DETAILED DESCRIPTION OF THE INVENTION

The present invention is directed to a socket for receiving a radiation source, such as a luminous source, such as a bulb or a discharge lamp, having a base, wherein the socket and the base, as partners, form counterparts which are shiftable relative to each other along an axis, in which a protuberance (projection) of one partner (the socket) correspond to a depression (recess) of the other partner (the base of the bulb or lamp). The socket has at least one protuberance (projection) which is slidably received in a groove-shaped recess of the base of the bulb or lamp.

The present invention also concerns a bulb or lamp equipped with a single-sided base for placement in a socket as defined hereinabove, which permits engagement of the base and socket through position, cross-sectional profile and/or the number of recesses of its base, wherein the base can slide onto protuberances of the socket.

Figure 1:
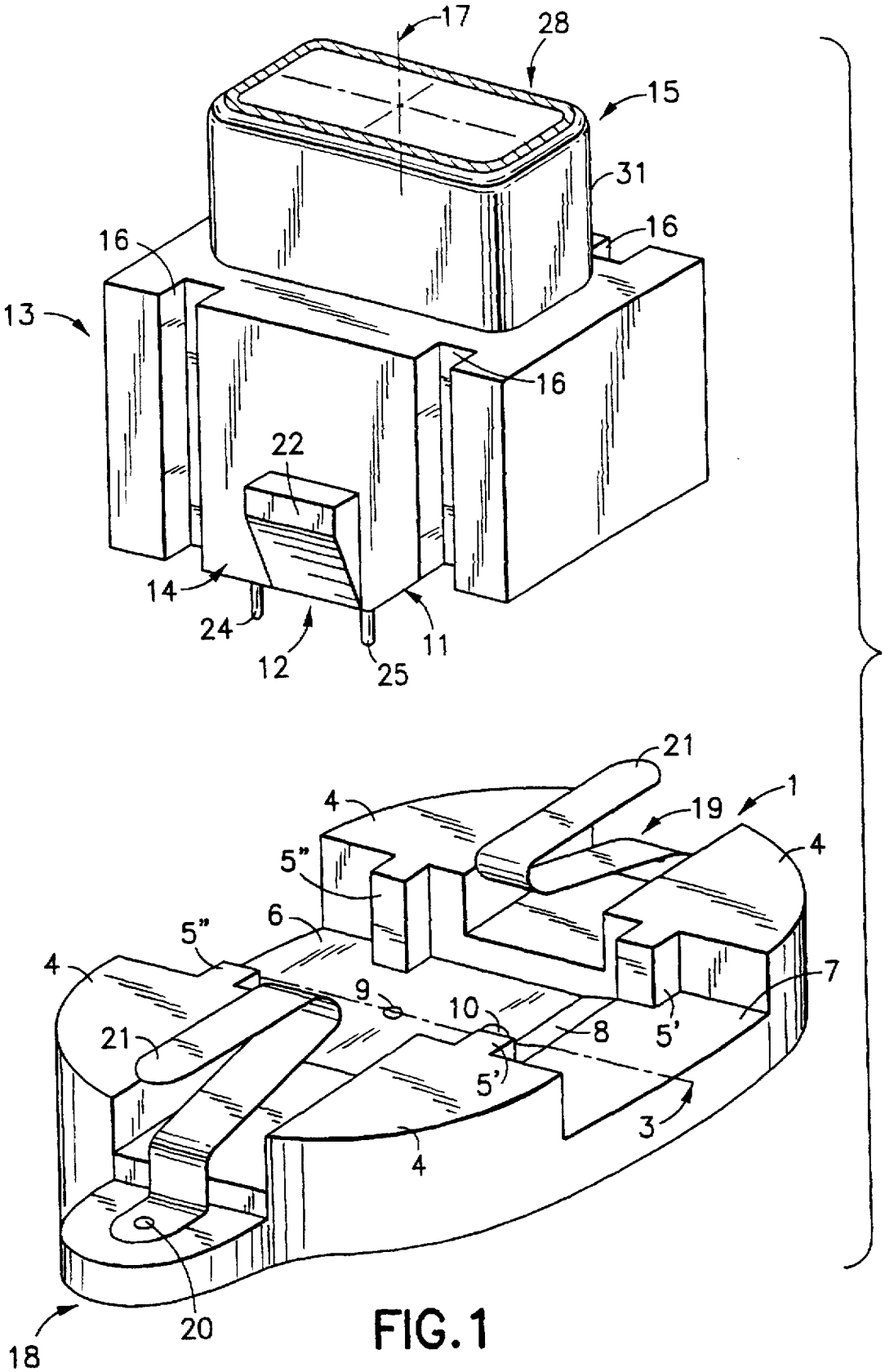
FIG. 1 is a perspective view of a discharge lamp (shown as a broken partial section) as a radiation source, such as a luminous source with a base, and a socket into which the base is to be inserted.

Referring to FIG. 1, the socket 1 includes along an axis of symmetry 3, stopping areas 4, which are each opposite to one another and which are each provided with "nose-like" protuberances (projections) 5', 5" which project toward the axis of symmetry 3. The nose-like protuberances 5' each rest on the elevated surface area 7, respectively, of the bottom of socket 1, whereas the nose-like protuberances 5", which are opposite to each other, extend downward into the recess (depression) 6 of the bottom of the socket 1.

When the socket 1 engages the base 13, in the area between the surface 7 and the recess (depression) 6, a ramp portion (inclined surface) 8 of the socket 1 will be in contact with the inclined sloping portion 11 of the base 13; and the underside surface portion 12 of the base 13 will extend into the recess (depression) 6 in the bottom of the socket and acts as a safeguard against twisting.

The base 13, which supports discharge lamp 31, has at each of its opposite broadsides 14,15, groove-shaped recesses 16 which act as keying slots when the base 13 is inserted into the socket 1 along the axis 17 in the direction indicated by arrow 28. The groove-shaped recesses 16 receive respectively the nose-like protuberances 5', 5" of the socket 1 (which act as keying protuberances). The recesses 16 and the protuberances 5', 5" also prevent a lateral shifting of the base 13 when it is engaged with the socket 1.

The socket 1 is provided at each of its opposite sides 18,19 with retaining springs 21 which are attached to the socket 1 by rigid attachment members (fasteners), such as rivets or screws 20. After insertion of the base 13 into the socket 1, the generally U-shaped retaining springs 21 grip holding noses 22 (one of which is shown in FIG. 1), which are located on the broadsides 14,15 of the base 13, in a "forceps-like" fashion. Thus the base 13 is held in a "force-locking manner" in the socket 1 by means of the U-shaped retaining springs 21.

Projecting from the underside 12 of the base 13 are contact pins 24,25, which are inserted in the contact openings 9, 10 of the depression 6 of the socket 1, when the base 13 is inserted in the socket 1 and the underside 12 of the base 13 then rests on the socket 1.

An additional encoding (keying) is made possible, not only by the nose-like protuberances 5', 5" with a special profile shape, but also due to the corresponding groove-shaped recesses 16, which can have, for example, rectangular, trapezoidal, semicircular and/or triangular cross-sectional profiles. In the exemplified embodiment shown in FIG. 1, rectangular profiles are provided. Different matching shaped surfaces of the base 13 and socket 1 can be provided, such as the inclined sloping portion 11 of the base 13 which matches-up with the ramp portion 8 of the socket 1 (which acts as a safeguard against twisting), as well as different positions or different pairings of the corresponding protuberances 5', 5" of the socket 1 and the groove-shaped recesses 16 of the base 13, which can be provided with various profiles, as shown in FIGS. 2*a*, 2*b*, 2*c*, 2*d*, 2*e* and 2*f*, and FIGS. 3*a*, 3*b*, 3*c*.

Figure 2A:
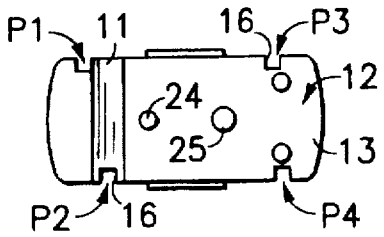
FIG. 2*a* is a bottom plan view showing the underside of the base.

FIG. 2*a* shows the underside 12 of the base 13 with inclined sloping portion 11 and the four positions P1, P2, P3 and P4 at which groove-shaped recesses 16 are located or can be located, respectively. To expand the encoding (keying) possibilities, one, two or three of the groove-shaped recesses 16 can be omitted on bases for various bulbs or lamps, so that a socket with a plurality of nose-like projections increased by one over the number of recesses 16 would not accept a base of this type (for example, a socket with four projections would not accept a base with three recesses). Moreover, it is also possible to expand the encoding (keying) possibilities by slightly shifting the nose-like projections 5', 5" relative to each other along the axis of symmetry 3 of the socket 1, so that only bases 13 with the correspondingly placed (anad shaped) groove-shaped recesses 16 can be inserted.

FIG. 2*a* depicts rectangular recesses 16. However, it is also possible, as shown in FIG. 2*e*, to provide combinations of differently shaped recesses on a single base, for example, trapezoidal recesses 16 can be provided at the positions Pi and P2 and rectangular profiles of the groove-shaped recesses 16 can be provided at the positions P3 and P4, respectively.

Figure 2B:
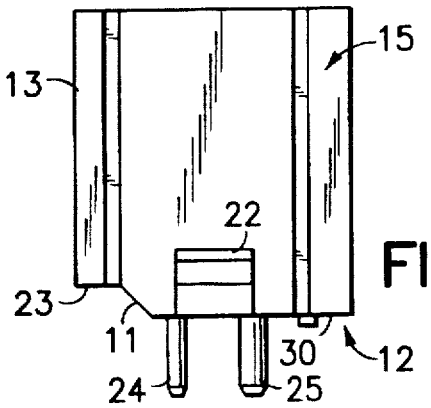
FIG. 2*b* is a side elevational view of the base.

FIG. 2*b* shows a broadside 15 of the base 13, showing the inclined sloping portion 11 of the underside 12 of the base 13 and an adjoining stopping surface 23. A dropped area 30 of the underside 12 of the base 13 is in contact with the depression 6 of the socket 1 when the base 13 engages with the socket 1. Contact pins 24,25 project downwards from the underside 12 of the base 13. It is also possible to create additional encoding (keying) possibilities for various bulbs or lamps by using different diameters for the contact pins 24,25 as shown in FIG. 2*b*, wherein the pin 25 has a larger diameter than the pin 24.

Figure 2C:
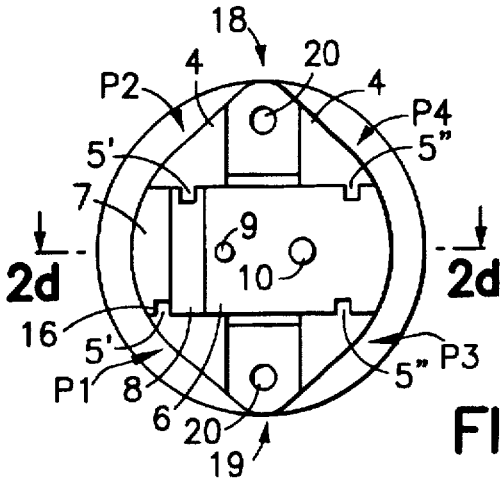
FIG. 2*c* is a top plan view of the socket, wherein retaining springs for the base are omitted for the purpose of better illustration.

FIG. 2*c* depicts a top view of the socket 1, wherein stopping areas 4 are each provided with nose-like protuberances 5' and 5". FIG. 2*c* also shows recess 6 having contact openings 9,10 with electric spring contacts 26,27 for receiving and contacting the electric contact pins 24,25 of the base 13. Furthermore, FIG. 2*c* shows the ramp portion 8 disposed between the elevated surface 7 of the bottom 2 of the socket 1 and the recess (depression) 6, which is provided with the contact openings 9,10. On the opposite sides 18,19 of socket 1 the attachment members 20 (shown, however, without the U-shaped retaining springs 21), are attached to the socket 1 in a fixed or rigid manner.

Moreover, the groove-shaped recesses 16 at positions P1 and P2 along the axis of symmetry 3 can be slightly shifted relative to each other, so that a base with mirror-inverted opposite recesses 16 at positions P1 and P2 would not fit in a socket 1 according to FIG. 2*c* with nose-like protuberances 5' at positions Pi and P2, which are shifted relative to each other.

Figure 2D:
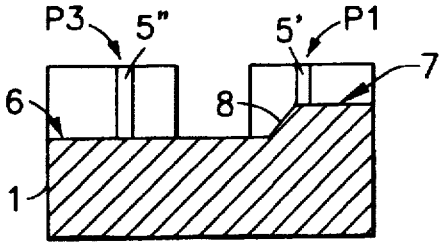
FIG. 2*d* is a sectional view taken along line 2*d*—2*d* of FIG. 2*c*, wherein certain components are omitted for better illustration.
Figure 2E:
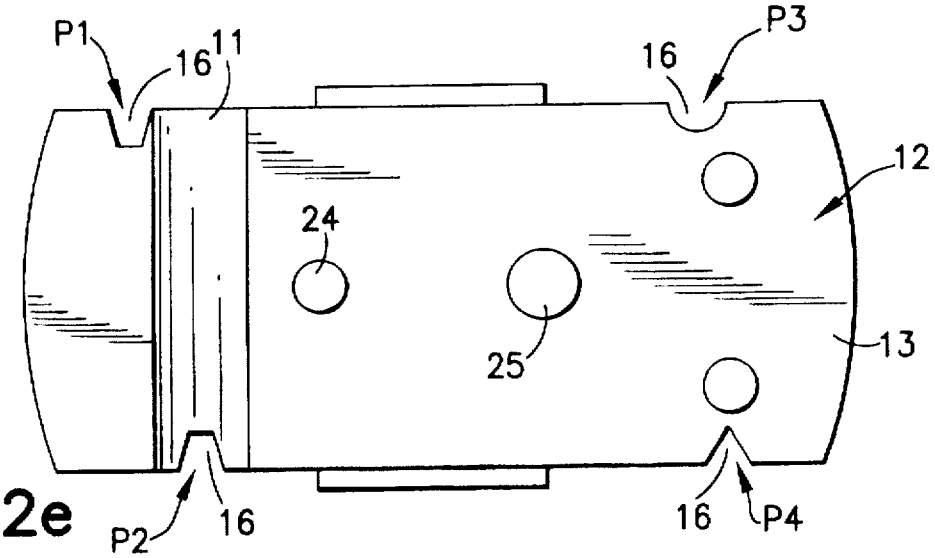
FIG. 2*e* is a bottom plan view like FIG. 2*a*, but enlarged, and showing trapezoidal recesses at positions P1 and P2, a semicircular recess at position P3 and a triangular recess at position P4.

FIG. 2*d* shows the recess 6 (which accommodates the contact openings 9,10, which are not shown), ramp portion 8 and the surface 7 of the socket 1. The positions of the nose-like protuberances 5', 5" are designated as P1, P3, respectively.

FIG. 2*e* shows trapezoidal recesses at positions P1 and P2, a semi-circular recess at position P3 and a triangular recess at position P4. Various shaped recesses in the base 13 at positions P1–P4 can be provided in any combination of shapes, and the socket 1 is correspondingly provided with respectively shaped protuberances at positions P1–P4.

Figure 2F:
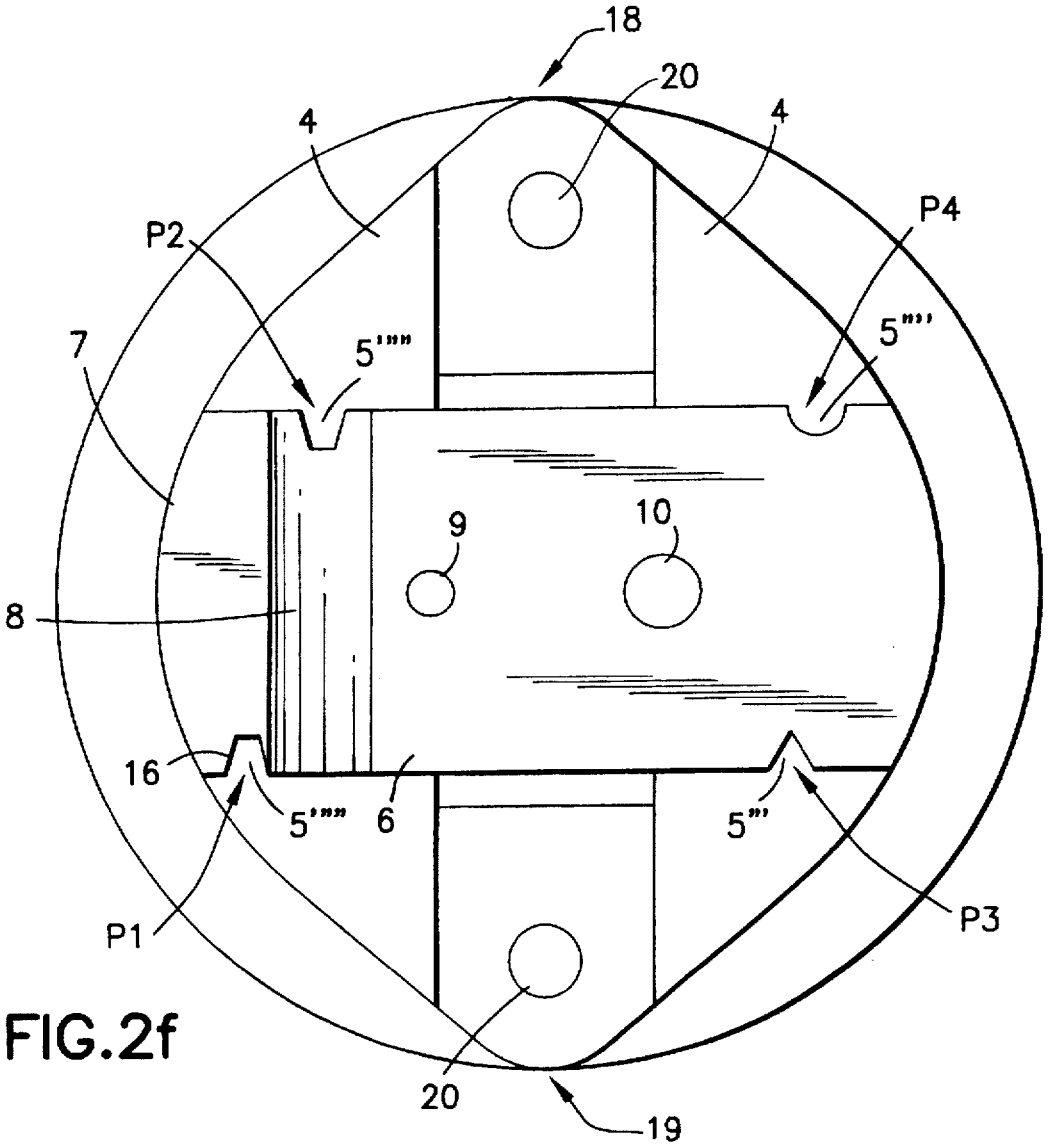
FIG. 2*f* is a top plan view like FIG. 2*c*, but enlarged, and showing trapezoidal projections at positions P1 and P2, a semicircular projection at position P3 and a triangular projection at position P4.

The socket shown in FIG. 2*f* includes nose-like protuberances 5"" with a trapezoidal profile at positions P1 and P2; a triangular nose-like protuberance at position 5"'; and a semi-circular nose-like protuberance 5"" disposed at position P4. It is thus possible to provide encodings for various bulbs or lamps by a variation of cross-sectional profiles for protuberances and recesses, which are fitted into corresponding sockets 1.

Figure 3A:
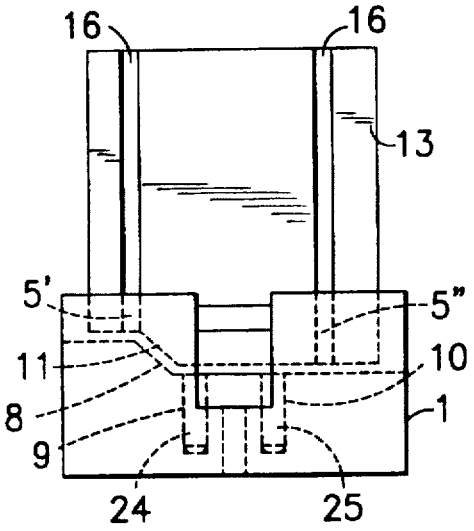
FIG. 3*a* is a side elevational view of the base inserted into the socket.

FIG. 3*a* shows the base 13 placed into the socket 1, wherein the inclined slopping portion 11 of the base 13 rests on the ramp portion 8 of the socket 1, while the respective nose-like protuberances 5', 5" of the socket I project into and engage the groove-shaped recesses 16 of the base 13. Additionally, FIG. 3*a* shows the contact pins 24,25, inserted into the contact openings 9,10 of socket 1.

Figure 3B:
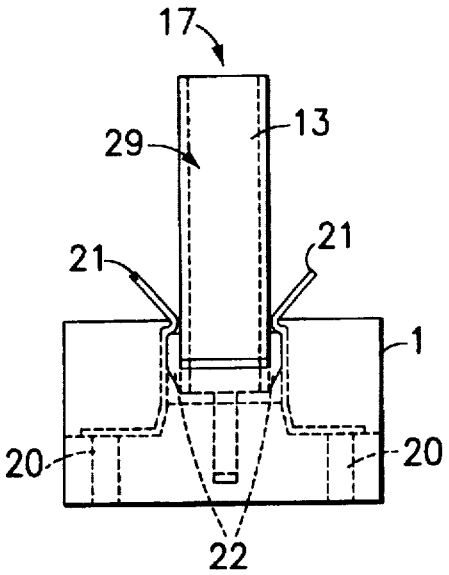
FIG. 3*b* is an end view of the narrow side of the base in the socket, wherein the retaining springs for (mechanically) holding the base to the socket, which were not shown in FIG. 2*c*, are shown.

FIG. 3*b* shows the base 13 disposed in the socket 1 from the vantage of the narrow side 29 of the base 13, wherein the U-shaped retaining springs 21 engage the holding nose 22 of the base 13 in such a manner that the base 13 is held by means of spring resistance of the U-shaped retaining springs 21 at the stop of the socket 1.

Figure 3C:
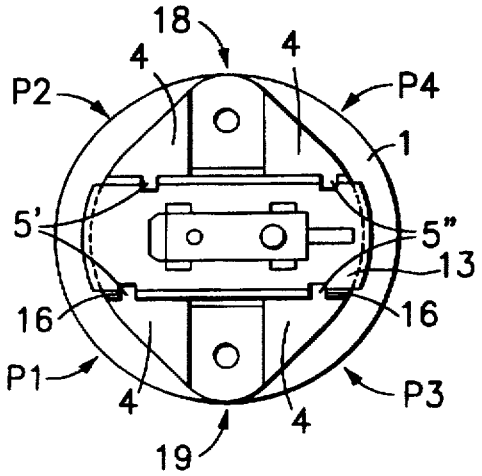
FIG. 3*c* is a top plan top view of the base inserted into the socket, wherein the bulb or lamp and the retaining springs for the mechanical holding of the base are omitted for better illustration.

FIG. 3*c* shows the groove-shaped recesses 16 of the base 13, as well as the corresponding nose-like protuberances 5', 5" at positions P1 and P2 along the axis of symmetry 3, which can be shifted slightly relative to each other, to permit greater encoding possibilities for various bulbs or lamps.

A major advantage of the present invention is that through the system of nose-like protuberances 5', 5", a multitude of encoding possibilities for various bulbs or lamps can be provided, whereby, for example, one of the nose-like protuberances 5', 5" can also be omitted, so that only a bulb or lamp with a base that matches the socket will be accepted.

It has proven advantageous that the socket of the present invention can be placed in a specific fixture category for which there must be compliance with certain criteria of bulbs or lamps.

A major advantage of the present invention is that through the variation of protuberances of the socket and recesses in the base in terms of insertion and positioning, an encoding ("keying") of several different bulbs or lamps for several different applications is possible, for example, four bulbs or lamps with varying power in four different types of fixtures can be engaged by the socket.

Another advantage of the present invention is that the keying feature cannot be defeated by removing or breaking-off projections (protuberances) on a lamp base (as can be done in the prior art), because the lamp base of the present invention has recesses, not projections or protuberances.

It will be appreciated that the instant specification is set forth by way illustration and not limitation, and that various modifications and changes may be made without departing from the spirit and scope of the present invention.

What is claimed is:

1. A socket for receiving a radiation source having a base, the base having at least one groove-shaped depression thereon, the socket comprising:

a bottom portion defining a receptacle for receiving said base, a pair of walls extending upwardly from said bottom portion and being spaced apart from each other so as to receive said base therebetween, at least one of said walls having at least one protuberance which projects inwardly of said socket toward the other of said walls, said at least one protuberance being receivable in a corresponding groove-shaped depression in said base so as to guide and retain said base in said socket, said socket and said base being shiftable relative to each other along an axis, wherein said at least one protuberance and said groove-shaped depression extend in a direction substantially parallel to said axis, wherein a portion of a bottom surface of the socket forms an elevated surface area for accommodating a correspondingly shaped area of an underside of said base, the socket further comprising a recessed surface having at least two spring contacts for receiving two contact pins of the base, the recessed surface being adjacent to a ramp area, the ramp area being adjacent to the elevated area of the bottom surface of the socket.

2. The socket of claim 1, wherein said at least one protuberance comprises a protuberance provided on each of said opposing side walls which project toward each other, and which are received in respective groove-shaped depressions of said base.

3. The socket of claim 1, wherein said at least one protuberance comprises at least two protuberances having at least two different rectangular shaped profiles onto which a base with recesses having corresponding profiles is slidably engageable; said base having at least one holding projection extending therefrom; said socket comprising at least one retaining spring member arranged to lockingly engage said at least one holding member of said base; said at least one holding projection having (i) an inclined surface extending from a bottom portion of said base, and (ii) a locking surface extending from said base, whereby said retaining spring member is slidably engageable on said inclined surface and, when the base is seated in said socket, the retaining spring member engages said locking surface.

4. The socket of claim 2, wherein a portion of a bottom surface of the socket forms an elevated surface area for accommodating a correspondingly shaped area of an underside of said base.

5. The socket of claim 4, which further comprises a recessed surface having at least two spring contacts for receiving two contact pins of the base, the recessed surface being adjacent to a ramp area, the ramp area being adjacent to the elevated area of the bottom surface of the socket.

6. The socket of claim 1, wherein said at least one protuberance comprise at least two protuberances having at least two different profiles, onto which a base with recesses having corresponding profiles is slidably engagable.

7. The socket of claim 6, wherein the profiles of the protuberances are rectangular, trapezoidal, semicircular or triangular.

8. The socket of claim 7, having two rectangular shaped protuberances.

9. The socket of claim 8, wherein said base has at least one holding projection extending therefrom, and wherein said socket comprises at least one retaining spring member to lockingly engage said at least one holding member of said base.

10. The socket of claim 9, wherein said at least one holding projection has (i) an inclined surface extending from a bottom portion of said base, and (ii) a locking surface extending from said base, whereby said retaining spring member is slidably engagable on said inclined surface and, when the base is seated in said socket, the retaining spring member engaging said locking surface.

11. The socket of claim 10, wherein a portion of a bottom surface of the socket forms an elevated surface area for accommodating a correspondingly shaped area of an underside of said base.

12. The socket of claim 11, which further comprises a recessed surface having at least two spring contacts for receiving two contact pins of the base, the recessed surface being adjacent to a ramp area, the ramp area being adjacent to the elevated area of the bottom surface of the socket.

13. A radiation source comprising:

a radiation emitting member and a base for supporting the radiation emitting member, said base having at least one groove-shaped depression for engagement with a socket, said socket having at least one protuberance being receivable in said at least one groove-shaped depression in said base, said socket and said base being shiftable relative to each other along an axis, said at least one protuberance and said at least one groove-shaped depression extend in a direction substantially parallel to said axis, wherein a portion of a bottom surface of the socket forms an elevated surface area for accommodating a correspondingly shaped area of an underside of said base; the socket further comprising a recessed surface having at least two spring contacts for receiving two contact pins of the base, the recessed surface being adjacent to a ramp area, the ramp area being adjacent to the elevated area of the bottom surface of the socket.

14. The radiation source of claim 13, wherein said at least one groove-shaped depression has a rectangular profile.

15. The radiation source of claim 13, wherein said at least one groove-shaped depression has a trapezoidal profile.

16. The radiation source of claim 13, wherein said base further comprises at least one holding projection extending therefrom for engaging a retaining spring member of said socket.

17. The radiation source of claim 13, wherein said base further comprises at least one holding depression therein for engaging a retaining spring member of said socket.

18. The radiation source of claim 13, wherein the radiation emitting member is a light emitting member.

19. A luminous source in combination with a socket comprising:

(a) a luminous source comprising (i) a light emitting member and (ii) a base for supporting said light emitting member, said base having at least one groove-shaped depression; and (b) a socket comprising:

(i) a bottom portion defining a receptacle for receiving said base of said luminous source, (ii) a pair of walls extending upwardly from said bottom portion and being spaced apart from each other so as to receive said base of said luminous source therebetween, at least one of said walls having at least one projection which projects inwardly of said socket towards the other of said walls, said at least one projection being receivable in a corresponding groove-shaped depression in said base of said luminous source so as to guide and retain said base of said luminous source in said socket, wherein a portion of a bottom surface of the socket forms an elevated surface area for accommodating a correspondingly shaped area of an underside of said base, the socket further comprising a recessed surface having at least two spring contacts for receiving two contact pins of the base, the recessed surface being adjacent to a ramp area, the ramp area being adjacent to the elevated area of the bottom surface of the socket, and said socket and said base being movable relative to each other along a given axis, and wherein said at least one projection and said groove-shaped depression extend in a direction substantially parallel to said given axis.

20. The radiation source of claim 13, wherein said at least one protuberance comprises at least two protuberances having at least two different rectangular shaped profiles onto which a base with recesses having corresponding profiles is slidably engageable; said base having at least one holding projection extending therefrom; said socket comprising at least one retaining spring member arranged to lockingly engage said at least one holding member of said base; said at least one holding projection having (i) an inclined surface extending from a bottom portion of said base, and (ii) a locking surface extending from said base, whereby said retaining spring member is slidably engageable on said inclined surface and, when the base is seated in said socket, the retaining spring member engages said locking surface.

* * * * *

UNITED STATES PATENT AND TRADEMARK OFFICE

CERTIFICATE OF CORRECTION

PATENT NO. : 5,795,192

DATED : August 18, 1998

INVENTOR(S) : Ullrich

It is certified that error appears in the above-identified patent and that said Letters Patent is hereby corrected as shown below:

Column 5, line 8, "5"""" should read --5"""'--.

Signed and Sealed this

Sixteenth Day of February, 1999

*Attest:*

*Attesting Officer*

*Acting Commissioner of Patents and Trademarks*